United States Patent [19]

Bryce

[11] 4,361,160

[45] Nov. 30, 1982

[54] METHOD OF FORMING ARTIFICIAL FINGERNAILS

[76] Inventor: Thomas M. Bryce, 5225 Evanston Ave., Indianapolis, Ind. 46220

[21] Appl. No.: 344,768

[22] Filed: Feb. 1, 1982

[51] Int. Cl.[2] ..... A45D 29/00

[52] U.S. Cl. ..... 132/73

[58] Field of Search ..... 132/73; 435/34

[56] References Cited

U.S. PATENT DOCUMENTS

| | | | |
|---|---|---|---|
| 2,899,712 | 8/1959 | Smith | 433/34 |
| 3,251,909 | 5/1966 | Pickands et al. | 433/34 |
| 3,928,113 | 12/1975 | Rosenberg | 132/73 |
| 4,299,243 | 11/1981 | Umstattd | 132/73 |

*Primary Examiner*—G. E. McNeill

*Attorney, Agent, or Firm*—Woodard, Weikart, Emhardt & Naughton

[57] ABSTRACT

A method of forming artificial fingernails includes the steps of forming a negative impression mold of a human finger, and then making an artificial plaster finger from that impression mold. Once the plaster finger has cured, a layer of tape which has been cut and shaped to the desired length and contour is applied to the outer end of the nail portion of that plaster finger. Thereafter, another negative impression is made and another artificial finger also of plaster is created. This second plaster finger is identical to the first with the addition of a plaster portion representing the artificial nail. This plaster finger is then coated with a lacquer to seal the plaster and a heavy layer of lacquer is placed over the nail portion after any unevenness has been smoothed out. Once the plaster finger is finished, the nail portion and surrounding top portion of the finger is covered with a layer of silicone rubber. After this layer cures, it is placed in a backing mold member which is filled with wet plaster. When the plaster sets, a silicone rubber master mold results. Artificial fingernail material is then placed in the mold and the mold is pressed onto the corresponding finger.

10 Claims, 8 Drawing Figures

METHOD OF FORMING ARTIFICIAL FINGERNAILS

BACKGROUND OF THE INVENTION

The present invention relates in general to methods of forming artificial nails, both for the fingers, thumbs and toes, wherein the artificial nail is formed from a synthetic mixture or compound. More particularly, the present invention discloses a method of forming such artificial nails from a master mold which is unique to the particular individual.

The desire of women to have stylish and fashionably long fingernails is complicated by the fact that natural fingernails may be quite fragile and subject to being broken or chipped as individuals move through their daily activities and tasks. The length of time required to grow "new" fingernails has prompted the development of a wide variety of artificial fingernails, methods of creating them, and artificial fingernail materials.

A majority of the methods of forming artificial fingernails involves shielding or protecting the surrounding finger and then brushing a synthetic compound which is typically in liquid form, over the natural nail and the end of the shielding form. In a few minutes, the liquid sets up into a hard and smooth nail. Thereafter the shielding form is removed, and the nail is filed to shape. The artificial compound is usually more durable than natural fingernails and thus, is less susceptible to breakage and chipping. While there are these types of benefits with artificial fingernails, there are also disadvantages. Artificial fingernails may be time-consuming to apply, time-consuming while waiting on the artificial mixture to cure and time-consuming as to the filing to shape of the finished artificial nail.

Listed below is a number of patent references, each of which relates in some respect to artificial fingernails and the method of preparing artificial nails. Additionally included and listed below is a number of advertising and newspaper literature detailing some of the artificial fingernail products that presumably were at one time available and may still be in existence.

| Patent No. | Patentee | Issue Date |
|---|---|---|
| 3,277,900 | Lappe | 10/11/66 |
| 3,157,912 | Lisczawka | 11/24/64 |
| 3,502,088 | Jarby | 3/24/70 |
| 3,037,514 | Lappe | 6/05/62 |
| 3,487,831 | Jaume et al. | 1/06/70 |
| 2,633,139 | Pettey | 3/31/53 |
| 2,979,061 | Greenman et al. | 4/11/61 |
| 2,941,535 | Lappe | 6/21/60 |
| 4,229,431 | Lee, Jr. et al. | 10/21/80 |
| 4,104,333 | Lee, Jr. et al. | 8/01/78 |
| 3,483,289 | Michaelson et al. | 12/09/69 |
| 3,574,822 | Shepherd et al. | 4/13/71 |
| 3,425,426 | Welanetz | 2/04/69 |

Lappe ('900) discloses a method for applying an artificial nail and protecting the surrounding nail tissue from irritating nail coating compositions. The first step in the method is to apply a coating around the boundary portion of the nail and allow this coating to dry thereby setting up a protective covering. Next, an artificial nail is formed and bonded by a suitable adhesive over the underlying natural nail.

Lisczawka discloses a fingernail and toenail mold construction for creating artificial fingernails and toenails. The molds are individually arranged such that one mold covers one nail, and they are differently sized for different nails of the fingers and toes. The center portion of each mold is cupped or dish-shaped suitable to receive a few drops of a nail-coating material. Thereafter, the damaged or broken fingernail is placed in the upside down mold and then turned so that the mold rests on the broken nail. The mold is then held in place for approximately 15 minutes in order to permit the material to dry and thereafter the finished artificial nail is filed to the desired shape.

Jarby discloses an artificial nail covering and a method of preparing the same wherein a layer of a cured bonding agent covers the nail and this bonding agent is in turn covered, although not necessarily completely, by a thin, shape-retaining artificial nail blank.

Lappe ('514) discloses an artificial nail and method wherein a form mold corresponding to the shape of the fingernail to be applied is first treated on its underside with a parting material that will minimize the adhesion between the underside and a plastic material which is subsequently used as a coating on the treated underside of the form mold. Thereafter a plastic material capable of setting to a hardened state is applied as a uniform coating on the treated side of the form mold until a relatively thick layer is built up. Thereafter, the form mold is applied to the surface of the natural nail and thereafter the built-up plastic layer is transferred to the natural nail.

Jaume et al. discloses an artificial nail which has a first wall portion formed with a concave undersurface and a second wall portion formed with a convex upper surface. The first wall portion overlies and is spaced from the second wall portion. Forward edges of the wall portions are joined together to form a pocket in which a human nail is insertable. Additional wall portions of the artificial nail extend substantially to the base of the human nail and are secured thereto by glue or cement. After the artificial nail is applied, fingernail polish may be painted on both the natural nail and the artificial nail in order to mask the fact an artificial nail is involved.

Pettey discloses a fingernail cover concept wherein a plurality of differently sized nail covers are disposed on a single card and are removable therefrom for application onto a natural nail. Each of these covers are a lamination of suitable transparent or translucent plasticized resinous material and the bottom layer is a pressure-sensitive adhesive suitable for adhering to the natural nail.

Greenman et al. discloses nail coverings and methods of making the same wherein variously sized artificial nail overlays are disposed on a common strip and are detachable therefrom. The purpose of these overlays is to preclude the need to brush on or apply artificial nails which may be improperly done by an inexperienced individual. A further object of the invention is to provide fingernail blanks which will adhere to the natural nails for an extended period of time, but which are easily and simply removable therefrom.

Lappe ('535) discloses an artificial nail covering and method of applying the same wherein an artificial nail is disposed completely over the natural human nail and is bonded thereto by a layer of adhesive. The artificial nail is arranged as a thin plastic member which is shaped to conform to the contour of the top side of the natural nail, and which includes a plurality of perforations. These perforations permit the bonding material to extend therethrough and thereby provide a much stronger and more rigid bond than what might be available by simply disposing a single layer of adhesive between the two nails.

Lee, Jr. ('431) discloses a self-curing artificial fingernail composition containing cross-linking monomers, monoacrylates, and suitable initiators and accelerators, and methods of polymerizing and applying the same.

Lee, Jr. (3 333) discloses much the same self-curing artificial fingernail composition as that of a previous Lee, Jr. patent reference.

Michaelson et al. discloses a human nail coating composition which is intended to be used for repair of broken, chipped or cracked nails as well as for making an application of preformed nail overlays in the form of false nails and extenders.

Shepherd et al. discloses cosmetic preparations such as powders and the like which are prepared by adding a powdered hydrophylic acrylate or methacrylate polymer to the selected powder cosmetic ingredients.

Welanetz discloses a nail patch and method of application wherein nail repair is provided for by a patch material of very sheer thickness fabric impregnated with a binding solution which is solvent activatable to adhere the nail patch material to the natural nail.

The last five patent references discussed above pertain primarily to the chemical composition of the artificial nail material and while this may be of interest in certain situations, it does not relate directly to the present invention. Although the present invention will use some type of composition material for the artificial nails which are formed, the particular material composition does not enter into the primary teachings of the present invention. Rather, the present invention is concerned with the method of forming the artificial nails and not necessarily with what they are formed of.

Additional disclosures which are felt to be somewhat relevant to the present invention are detailed by the following four items. The first item is a magazine advertisement published by Lee Pharmaceuticals and involves a product referred to as "Lee Nails." According to this advertisement, the artificial nail is formed by brushing a synthetic material over the natural nail and the surrounding finger is protected by a covering. After the composition material hardens the nail is filed to the desired length and shape and thereafter nail polish is applied. One additional portion of this advertisement which may have some applicability to the present invention is the disclosure of gold-plated charms which may be applied to the polished nail and glazed in placed.

The next reference is a magazine article entitled "The Fabulous World of Fingernails" and which was written by Janet Spencer King. Unfortunately, the publication that this article was taken from is not at the present time known. However, what is disclosed is a method and concept very similar to that described by the Lee Pharmaceuticals magazine advertisement. However, in this case while a variety of products may be previewed, the illustrated method of applying the artificial nails includes the use of a silver-foil form which is placed under each natural fingernail tip and over which a liquid acrylic is applied. The final steps as before are to file the nails to the desired length and shape and apply nail polish.

The third reference is a newspaper advertisement published by the Nails 'n Lashes Studio. What is disclosed is a process that takes approximately 2 hours for a beauty shop technician to put forms on your fingers and to shape new nails. The newspaper article implies that some liquid and powder mixture is applied and after it sets and hardens, the artificial nails which are created may be filed to the desired length and shape and then nail polish applied. One concern which is acknowledged by this particular newspaper article is that since the artificial fingernails are applied completely over the natural fingernails, a gap will occur as the natural fingernails grow. This gap appears at the base of the nail just above the cuticle, and the newspaper article indicates that after 3 or 4 weeks of growth, it is advisable that one return to the studio (or beauty salon) and have this gap filled in with additional compound.

The final reference is a small advertisement brochure from a company entitled "Ladyfingers" located in Pasadena, California. This particular publication also discloses the use of a form which is placed beneath the natural nail and around the finger. A liquid is brushed over the nail and form which then sets to a hard condition after which the form is removed. Finally, the nail is sculptured and finished, and nail polish applied. This publication also acknowledges the requirement for a "fill-in," this time after 2 to 3 weeks of natural nail growth.

Based upon these various patent references and the additional information provided, a few very common approaches and trends can be ascertained. First of all, the majority of the disclosures involve some type of form or shield being placed beneath the fingernail and around the finger. Next the synthetic artificial nail material, presumably always in liquid form, is brushed over the natural nail and over the outwardly extending end of the form. After this synthetic artificial nail material hardens, the form is removed leaving an extended portion of artificial nail material. It is this extended portion which is then filed to length and shape after which time nail polish is applied. When this method is used, it is required that fill-in work be done somewhat frequently as the natural nail grows out from the location of the cuticle. Additionally, covering the entire natural nail adds an increased thickness which may present an unsightly curvature or contour to what one normally expects to see as fingernails. These methods of applying artificial fingernails are quite time-consuming, both for the customer and for the manicurist or beautician. The particular form must be carefully applied to each nail individually and thereafter each nail must be brushed with the artificial nail material over its entirety. A great deal of care must be taken with the brushing so as to provide a properly adhering substance as well as a smooth and uniform coat. It is also quite difficult to sculpt the end of the artificial nail when one is merely brushing over a variable form and consequently, the amount of filing and shaping required after the artificial nail material cures is excessive. In view of these drawbacks, the general technology of forming and applying artificial nails would be improved if it was possible to eliminate the need to "fill-in" at the base of the artificial nail as the natural nail grows. A further improvement would be to reduce the overall time required both as to preparation of the nail and the filing and shaping after the artificial nail material has hardened.

The present invention provides each of these improvements and a number of other very novel and unique concepts for artificial nails. What is disclosed is a method of applying artificial nails that not only provides the two improvements mentioned, but also offers a wide variety of options that individuals may elect without drastically revising the general step-by-step method which is disclosed herein.

SUMMARY OF THE INVENTION

A method of forming artificial fingernails according to one embodiment of the present invention comprises the steps of forming an impression mold of a human finger, making an artificial finger from the impression mold, applying a layer of material shaped to resemble a portion of a fingernail to the artificial fingernail, forming a master mold of the artificial finger and of the layer of material, adding an artificial fingernail material into the master mold then placing the human finger in the master mold.

One object of the present invention is to provide an improved method of forming artificial fingernails.

Related objects and advantages of the present invention will be apparent from the following description.

DESCRIPTION OF THE PREFERRED EMBODIMENT

Figure 1:
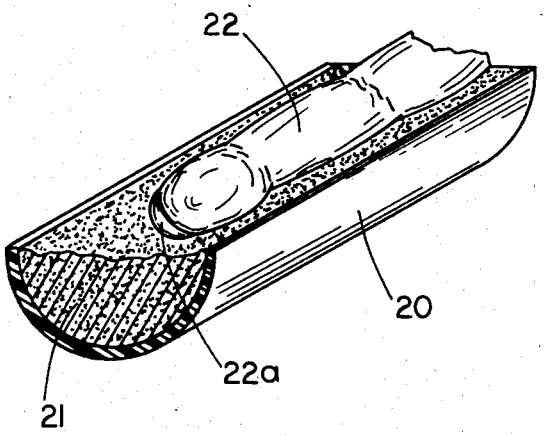
FIG. 1 is a perspective view of a human finger disposed in the mold for making an impression according to one step of of a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention involves a method of forming artificial fingernails and as will be apparent by the nature of the present invention, the somewhat specific term "fingernails" should be interpreted as including fingernails, thumbnails and toenails. The method of forming artificial fingernails according to the present invention involves a series of steps which are illustrated by FIGS. 1–6 and which will be described in detail hereinafter.

The process begins with the creation of a backing member 20 into which an impression-making compound 21 is placed. Thereafter, a human finger 22 (or thumb or toe) is placed in the compound, and is pressed into place so that the compound completely covers at least the top half portion of the finger and the entire area of the nail 22*a*. The impression-making compound is an alginate and cold water mixture which is mixed separately and then poured into the backing member. The consistency and density of this material compound assures a virtually perfect negative impression. Once the impression-making compound 21 cures, what is left is a cavity that constitutes a negative of the human finger and the mold which results is then able to be used for the casting of a plaster finger 23 which is illustrated in FIG. 2.

When the plaster and cold water are mixed, a sufficient quantity is prepared in order to fill the negative impression mold and after the plaster mixture is added, the mold is lightly tapped in order to reduce, or hopefully eliminate, all the air bubbles. Thereafter, extra plaster is added and mounded so as to complete the finger (if desired) and create a finger hold 24 for future handling and manipulation of the plaster finger 23. After the plaster cast of the finger is fully set up, it is removed from the negative impression and is brushed with a thinned lacquer in order to seal the pores so that they will not subsequently absorb moisture. The alginate negative impression mold is thereafter stored in a humidor type container in order to preserve it for possible future use. Additional alginate negative molds may be made from a positive plaster finger.

Since the impression-making compound is an alginate compound, very similar to what is used presently to make dental impressions, it is durable and will last for some time with proper care. Further, by constructing the backing member of hard plastic or other durable material, the finger negative mold which is made may be retained for future use, if necessary. The deeper the human finger is pushed into the alginate compound, the larger the plaster finger will become; however, if the human finger is pushed more than half way, removal from the cured alginate compound may be difficult. For this reason, the actual plaster finger may be only one-half of a finger and the balance of the casted appendage will be jagged and uneven if not scuplted to complete the finger. In order to show a true plaster finger, the illustrations of FIGS. 2 and 4 do not shows an uneven and jagged bottom edge but rather, the shape of an actual finger.

Figure 2:
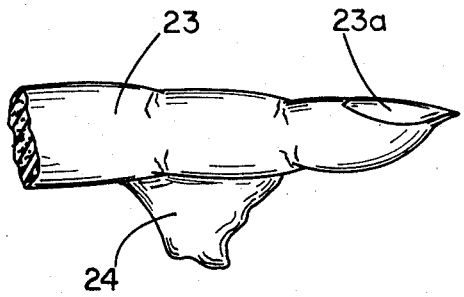
FIG. 2 is a perspective view of an artificial finger which was made from the impression mold of FIG. 1.
Figure 3:
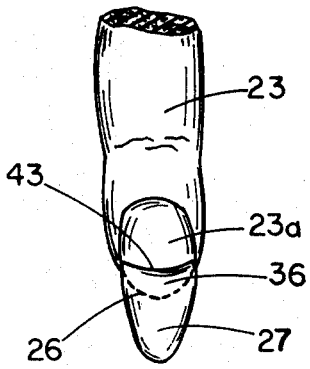
FIG. 3 is a top plan view of the FIG. 2 finger with a layer of material applied over a portion of the nail area.
Figure 4:
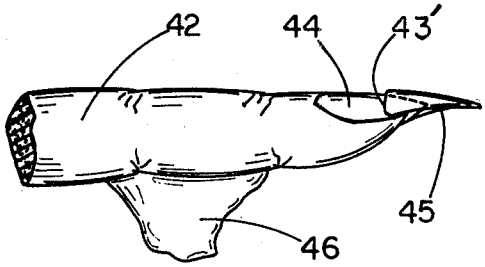
FIG. 4 is a side elevation view of an artificial finger with a final nail portion cast therewith.

Once the plaster finger is created, as illustrated in FIG. 2 as well as in FIG. 3, it is then time to sculpt the desired length and shape for the artificial nail. Referring to FIG. 3, plaster finger 23 is illustrated in a top plan view illustration and broken line 26 represents the outer edge of nail portion 23*a* which coincides with the existing nail on the human finger used to make the mold. Although we are still dealing with a plaster finger, references to portions of the human finger are appropriate since a very accurate and precise plaster finger was made from the alginate mold of FIG. 1.

Next, a thin layer of material 27 is applied to the outer end of the nail portion of plaster finger 23. This layer of material is preferably synthetic in nature and may be, for example, a thin piece of plastic or tape. This tape overlaps only the end of the nail portion as indicated by area 36. If the layer of material that is used is not self-adhering, then a small amount of adhesive may be used in order to bond this layer of material to the nail. This thin layer of material is preferably trimmed to the desired length and contour by a pair of scissors or similar means prior to applying it to the nail. One material which proves to be quite satisfactory for this particular layer of material is any one of the frosted or cellophane tapes. In order to enhance the adherence of the tape to the plaster nail, the nail portion is first coated with a fingernail lacquer.

This plaster finger and taped artificial nail of FIG. 3 are then returned to a backing member which is filled with an alginate compound in the manner of FIG. 1, and a new negative impression mold is formed. This time the alginate mold is of both the finger and the desired style of nail. Therafter, a plaster master 42 is cast (see FIG. 4) and the ridge 43 resulting from the tape overlap, which is now plaster ridge 43', is buffed out and the finger is sealed with lacquer. This final plaster master includes plaster finger 42, original nail portion 44, artificial nail portion 45 and holding means 46. A broken line is shown beneath artificial nail portion 45, but this is only to suggest the relationship of the artificial nail to the natural nail. After the finger is sealed, a heavy lacquer is applied over the nail portion of this plaster master in order to give a smooth appearance to the exterior surface of the nail (44 and 45). It is this second plaster finger which is used to make the master permanent mold.

Figure 5:
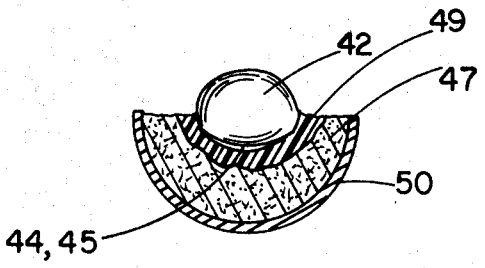
FIG. 5 is a front elevation view in full section illustrating the laminated layers involved in making the master mold for the method of the present invention.

The top half of this second plaster finger is next brushed with an application of silicone rubber which is allowed to cure. Thereafter, this coated plaster finger is placed into a wet plaster mixture that is retained in a backup member. This step is illustrated by FIG. 5 wherein plaster finger 42 which has been coated with the layer 49 of silicone rubber is pressed into a plaster backup member 50 whose center cavity is filled with wet (uncured) plaster 47. As a result, the silicone rubber and plaster form a mold which is subsequently used to apply the artificial nail material to the live (natural) finger.

Figure 6:
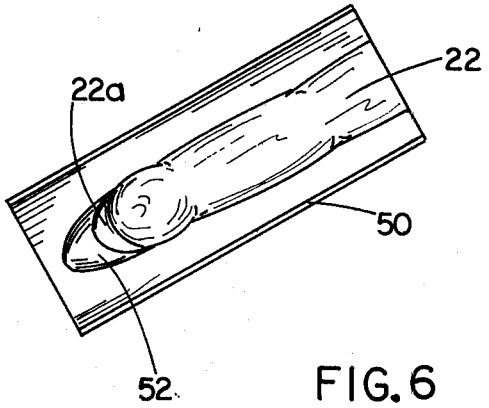
FIG. 6 is a top plan view of a human finger placed within the FIG. 5 master mold after addition of artificial fingernail materials.

The final step is then to mix the artificial nail materials and distribute them to cover the area of the nail cavity in the silicone master mold (see FIG. 6). While the degree of coverage may vary, it is important that approximately 1/16" space be left above the cuticle so that the nail materials do not cover the living portion of the nail. It is envisioned that a two-part or two-step procedure will be used first to apply a first layer of artificial nail material into the mold and thereafter a second layer of artificial nail material which acts as adhesive to bond the first layer to the natural nail. Once these layers have been applied to the silicone rubber master mold, the mold is placed or positioned over the natural finger 22 and lined up with the nail and pressed firmly in position. This pressing action squeezes out all excess material except for that which fills cavity 52 and that which flows into the overlap area 36. Cavity 52 is formed in the master mold by that portion of plaster corresponding to the desired artificial nail. Consequently, if the natural nail is different from the shape of cavity 52, space is left which is filled by the artificial nail compound. Thereafter, in approximately 4–5 minutes, the material fully sets up and the mold is removed. Although there may be some excess material, it is minimal and may be easily removed. Any excess material at the tip of the artificial nail can be easily trimmed off and thereafter the artificial nail sealed with a lacquer or nail polish for the desired appearance.

Figure 8:
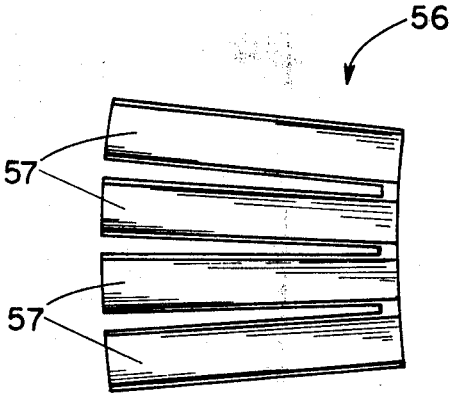
FIG. 8 is a top plan view of a multiple cavity mold suitable for use as part of the present invention.

Although in FIG. 1 a single backing member and single mixture of the alginate impression-making compound has been disclosed, it should be understood that a plurality of similar backing members (mold cavities) could be employed as illustrated in FIG. 8 whereby all the fingers of a hand may be placed in their own backing member and thereby create at one time a plurality of negative impression molds for each of these fingers. Mold 56 includes one backing member 57 for each finger and these are spaced so that they agree with the spacing of the fingers on the hand. Thereafter, the forming of the artificial nails may be done in multiple fashion using the multiple backing members and their resultant molds.

Although the creation of two plaster fingers has been described wherein the final one includes a plaster cast of the desired artificial nail, a couple of variations are possible. The first variation is to apply the tape layer for the artificial nail directly to the natural finger. Thereafter, the formed alginate negative impression can be used to create the FIG. 4 plaster master in one step. The remainder of the procedure is the same, leading to the silicone rubber master mold. The benefit of this variation is to reduce the number of steps leading to the creation of the silicone rubber master mold. The disadvantage is that the customer must remain a part of the procedure for a longer period of time. This is due to the fact that the tape layer must be trimmed and shaped while on the customer's finger.

Another variation is to go directly to the application of silicone rubber (FIG. 5) after the tape layer is applied to the first plaster finger. The benefit of this approach is to eliminate the need for the second plaster finger, but the disadvantage is that the tape edge on the nail area cannot be rubbed (or sanded) out. Consequently, the silicone rubber master mold will retain this raised edge. Thus, the cured artificial nail material would have to be sanded after the nail is formed. However, it is much easier to sand and smooth out this edge one time when it is plaster as opposed to every time for the much harder artificial nail material.

One advantage of the present invention is that the master mold created by the step illustrated in FIG. 5 remains available for that particular finger for that particular customer or user forever. Any time the individual goes back to the beauty salon or manicurist, the master molds for that individual's hand can be retrieved and any broken or damaged nails can be quickly and conveniently repaired or replaced as detailed by the step of FIG. 6. The various method steps in creating the various molds and the final master mold as presented by FIGS. 1–6 must only be done once. The final product occurring after the FIGS. 5 and 6 master mold is created is a durable and life-long mold that may be used over and over again. The silicone rubber serves as an ideal mold release for the cured artificial nail material and has the added benefit of very accurately conforming to all the shapes and intricacies of the plaster finger and nail. It is also envisioned as one possibility that a mold for a finger of the left hand may match the corresponding finger of the right hand. This can be checked for each customer and possibly reduce the total number of molds to be made.

On any future visit to the manicurist, all that the individual need do is place the appropriate finger in the appropriate master mold and pour or brush in additional artificial nail compound into the open portion of cavity 52. The finished shape and length of the artificial nails will always be the same, and the individual is not troubled by each artificial nail being different each time they are applied. Further, since the edge denoting the overlap of artificial nail is smoothed out on the plaster finger and the artificial portion does not cover the entire natural nail, there will not need to be any "fill-in" as the natural nail grows.

Figure 7:
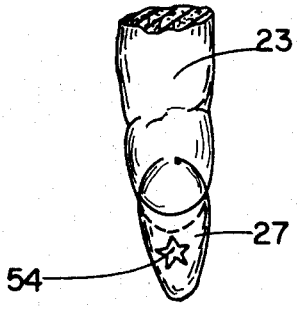
FIG. 7 is a top plan view of the FIG. 2 finger with a layer of material and a design applied thereto.

The present method also permits the master mold to be redesigned at any point in time that the individual wishes. All that must be done is to take the originally formed plaster finger, that resulting after the FIG. 2 stage, and restructure the layer of material 27 which is added to the nail portion. Thereafter, a new master mold can be made and new nails created. It would also be possible for one individual to have several master molds for each finger so that if nail length is desired to be changed, primarily lengthened, then the existing finger and nail could simply be placed in a different mold with a longer artificial nail size and more material added to lengthen the artificial nail. In this regard, it is also possible, as is illustrated by FIG. 7, to add decorative shapes, decals or symbols. In the FIG. 7 illustration, a raised star 54 has been applied to the layer of material 27 which has been applied to plaster finger 23. This raised star may be any type of symbol or ornament, and one very common source for such decorative additions are sequins and small charms. Once the decorative addition is bonded to the layer of material, the final plaster finger is cast and the silicone rubber master mold is made. Alternatively, such shapes may be added to final plaster finger 42 by either modifying the plaster or using adhesive. With either approach, the result is a deeper recess in the area of cavity 52 in the master mold so that when artificial nail material is added to this deeper recess, a raised star shape of artificial nail material will be created. Thereafter, this raised star or whatever ornament or decorative addition is desired, may be separately colored in either a contrasting or matching shade to the nail polish which is used for the nail. A still further alternative is to apply an actual gem stone or similar item. To accomplish this the item is first applied to finger 42 for creation of a depression in the silicone rubber master mold. Thereafter, the item is removed and placed in that depression before nail material applied.

It is also conceivable to add various pigments to the artificial nail material which is selected so that the resulting nail that is created is already impregnated with the desired color pigment so that nail polish need not be used. Of course, there are certain drawbacks with this method, due to color preferences and changes and the inability to somewhat rapidly transform the nail color from one shade to another. However, it does have advantages from the standpoint of durability and long life. With this method there will virtually never be the problem of chipping or nail polish delaminating.

While we have mentioned that the artificial nail material may be any one of those artificial nail materials which are presently available and which are used as part of other methods, it is also conceivable due to this particular arrangement that an epoxy type of material may be used for the artificial nail. One very clear advantage of the epoxy material is that it will withstand nail polish remover better than the conventional artificial nail materials. A possible drawback to the use of epoxy is that it may be somewhat more difficult to lay up in the desired shape and thickness for the artificial nail. However, with the present invention, the artificial nail material is poured or brushed into a mold and this is of minimal concern. In those earlier methods where a form or shield was placed beneath the natural nail and the artificial nail material was brushed over the natural nail, there would be concerns regarding the consistency of the artificial nail material, and specifically what materials could be used. With the present method and arrangement, virtually any material can be used and these types of concerns are eliminated due to the presence of the mold. Consequently, while the other methods will not permit the use of epoxy, the present method and arrangement does and thus, it is possible with the present invention to create a much more durable and impervious artificial nail.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of forming artificial fingernails which comprises the following steps:
   - forming a negative impression mold of a human finger;
   - making an artificial finger from said impression mold;
   - applying a layer of material shaped to resemble a portion of a fingernail to said artificial finger;
   - forming a master mold of said artificial finger and said layer of material;
   - adding artificial fingernail material into said master mold; and
   - placing said human finger in said master mold.

2. The method of claim 1 which further includes the step of making a negative impression mold of said artificial finger and said layer of material.

3. The method of claim 1 wherein said master mold is made of silicone rubber.

4. The method of claim 1 wherein said artificial fingernail material is an epoxy compound.

5. The method of claim 1 which further includes the step of applying a decorative shape to said layer of material prior to forming said master mold.

6. The method of claim 1 wherein a plurality of negative impression molds is made simultaneously for adjacent fingers of a human hand.

7. A method of forming artificial fingernals which comprises the following steps:
   - applying a layer of material shaped to resemble a portion of a fingernail to a human finger;
   - making a negative impression mold of the human finger with the layer of material applied;
   - forming an artificial finger and nail from said negative impression mold;
   - forming a master mold of said artificial finger and nail;
   - adding artificial fingernail material into said master mold; and
   - placing said human finger in said master mold.

8. The method of claim 7 wherein said master mold is made of silicone rubber.

9. The method of claim 7 wherein said artificial fingernail material is an epoxy compound.

10. The method of claim 7 which further includes the step of applying a decorative shape to said layer of material prior to forming said master mold.

* * * * *